US007150703B2

(12) United States Patent
Gary

(10) Patent No.: US 7,150,703 B2
(45) Date of Patent: Dec. 19, 2006

(54) ABDOMINAL EXERCISE DEVICE

(76) Inventor: Paul R. Gary, 1900 Fox Tower 805 SW. Broadway, Portland, OR (US) 97205

( * ) Notice: Subject to any disclaimer, the term of this patent is extended or adjusted under 35 U.S.C. 154(b) by 58 days.

(21) Appl. No.: 10/625,019

(22) Filed: Jul. 23, 2003

(65) Prior Publication Data

US 2005/0020417 A1 Jan. 27, 2005

(51) Int. Cl.
*A63B 26/00* (2006.01)

(52) U.S. Cl. ..... 482/140; 482/907

(58) Field of Classification Search ..... 482/140, 482/91, 907, 23; D21/665, 687, 676, 686, D21/662, 690; 5/431
See application file for complete search history.

(56) References Cited

U.S. PATENT DOCUMENTS 1,668,489 A * 5/1928 Brand ..... 5/630
1,869,460 A * 8/1932 Brand ..... 606/240
2,521,530 A * 9/1950 McGuffage ..... 5/630
4,288,879 A * 9/1981 Pate ..... 5/631
D279,642 S * 7/1985 Ross ..... D6/596
4,624,021 A * 11/1986 Hofstetter ..... 5/632
D289,481 S * 4/1987 Reddick ..... D6/601
4,775,148 A 10/1988 McLaughlin
4,969,222 A * 11/1990 Serola ..... 5/630
5,199,124 A * 4/1993 Klemis ..... 5/630
5,232,425 A * 8/1993 Miller et al. ..... 482/121
5,755,647 A 5/1998 Watnik
5,820,535 A 10/1998 Van Der Hoeven et al.
6,022,303 A * 2/2000 Abdo ..... 482/140
6,044,505 A * 4/2000 Friedman ..... 5/631
6,068,580 A 5/2000 Myers et al.
6,319,180 B1 11/2001 Kallassy
6,349,437 B1 * 2/2002 Horning ..... 5/632
6,436,020 B1 8/2002 Weingand
6,626,808 B1 * 9/2003 Adams ..... 482/140
D504,269 S * 4/2005 Faircloth ..... D6/601

* cited by examiner

*Primary Examiner*—Lori Amerson
(74) *Attorney, Agent, or Firm*—Chernoff, Vilhauer, McClung & Stenzel, LLP

(57) ABSTRACT

An exercise method and device for providing resistance to a user in the performance of an abdominal crunch exercise while the user is lying supine. The method includes the placement of resistance in the path of the exercise movement with the upper arms and upper legs simultaneously pressing toward one another against the resistance resulting in flexion of the torso and stress upon the abdominal muscles. The device comprises a resilient and compressible object or pad of material having a first substantially planar surface for placement upon the abdomen of the user, a second surface extending at an obtuse angle to the first surface and sized and shaped to engage the upper thighs of the user while performing said crunch exercise, and a third surface extending at an obtuse angle to the first surface and sized and shaped to contact the arms of the user while performing a crunch exercise.

7 Claims, 1 Drawing Sheet

ABDOMINAL EXERCISE DEVICE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The following invention relates to an exercise method and device and more particularly, an exercise method and device for helping to strengthen the abdominal muscles.

Abdominal exercises can be difficult to perform in a way that maximizes the desired effect of strengthening these muscles without causing injury and without involving other muscle groups which may detract from the effectiveness of the exercise. Many abdominal exercises, such as crunches, are done by isometrically contracting the abdominal muscles. For an isometric contraction, static equilibrium (i.e., the lack of motion) during the exercise is achieved by co-contraction of the abdominal muscles (rectus abdominis, internal obliques and external obliques) and the muscles of the lower back. However, stress on the lower back is increased when muscles surrounding the spine contract. Biomechanical stress associated with low-back injury is primarily the result of compressive forces on the intervertebral discs of the spine. These compressive forces are the result of the effects of gravity acting on the body above the lower back when the body is upright and the forces produced by muscles surrounding the spine to counteract flexion-extension moments. It would be advantageous to eliminate the contraction of the back muscles when the abdominal muscles are exercised.

For many isotonic abdominal exercises, such as leg lifts or sit-ups, the forces that must be generated by the abdominal muscles are determined by the weight of the torso and/or the legs. If the person cannot generate enough force to overcome this weight, the exercise cannot be performed. This is also true for many abdominal exercise machines that employ weights or springs. For many people, the level of exertion required to perform the exercise is too high and can result in stress on the lower back that can, in turn, cause injury. Thus, traditional exercises and devices require postures that are often stressful on the lower back or are too difficult to maintain.

Moreover, the actual exercise of the abdominal muscle is reduced by the natural increase of momentum of the torso and/or legs during a crunch, sit up or leg lift. Controlled uniformity of contraction produces more efficient and effective exercise.

Uniformity of contraction of the upper and lower abdominal muscles throughout their range of motion is enhanced by simultaneously engaging both the upper and lower torso, i.e., bringing the chest toward the legs and the legs toward the chest. The term "crunch" exercise as used herein is intended to refer to this movement. The term "crossover crunch" or "crossover" depicts a crunch in which the user presses one side of the upper torso toward the opposite leg while pressing that leg toward the moving aspect of the torso.

BRIEF SUMMARY OF THE INVENTION

A method of performing an abdominal crunch exercise includes the steps of placing an object on the anterior torso of a user while the user is lying in a supine position. The object lies in the path of the exercise and provides resistance to a compressive force. The user engages the object with the upper thighs and with the arms and attempts to compress the object by contracting the abdominal muscles.

In its broadest sense, the object used in the method includes oppositely disposed surfaces for engaging the respective arms and thighs of the user. A resistance is placed between the oppositely disposed surfaces to resist the movement of the surfaces toward each other which movement is caused by contraction of the abdominal muscles.

The foregoing and other objectives, features and advantages of the invention will be more readily understood upon consideration of the following detailed description, taken in conjunction with the accompanying drawings.

BRIEF DESCRIPTION OF THE SEVERAL DRAWINGS

DETAILED DESCRIPTION OF THE INVENTION

Figure 1:
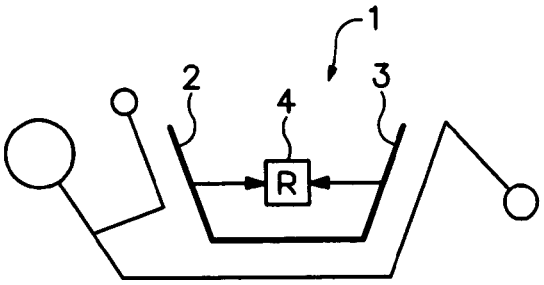
FIG. 1 is a side elevation schematic view of a user performing an abdominal crunch exercise according to the method of the invention.

Referring to FIG. 1, a user places an object 1 so that it rests against the anterior torso. The user's knees are raised. The object has surfaces 2 and 3 for engaging the arms and the upper thighs respectively. The surfaces 2 and 3 may be substantially planar but may also be contoured to facilitate receipt of each arm and leg of the user. As used herein, the term "surface" may also encompass separate surfaces independently engageable by each of the user's arms and legs. A resistance 4 is placed between the surfaces 2 and 3 in the path of the exercise. When the user presses the arms and legs toward each other, the abdominal muscles contract. As the surfaces 2 and 3 move toward each other but they will encounter the resistance 4 which will resist such movement. The resistance 4 may take any convenient form including springs, hydraulic, magnetic or pneumatic devices or a resilient compressible material.

Figure 2:
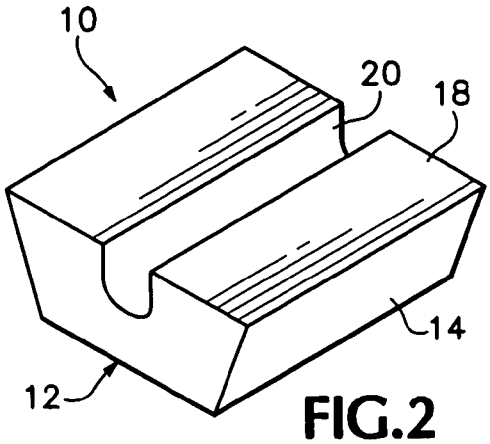
FIG. 2 is a perspective view of an exercise pad for use in performing a crunch exercise.
Figure 3:
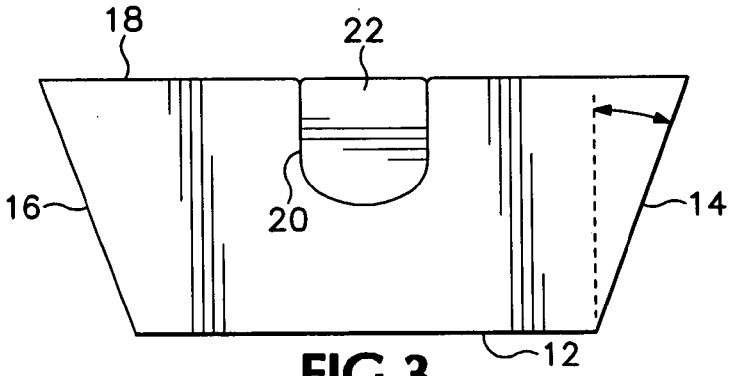
FIG. 3 is a side view of the pad at FIG. 1 including a resistance insert.
Figure 4:
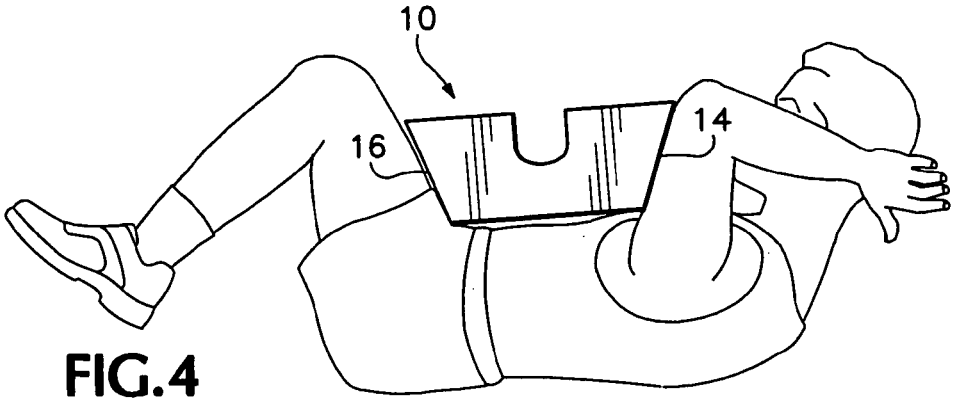
FIG. 4 is a side view of the exercise pad of FIG. 1 in use with the user's hands extended behind the head.
Figure 5:
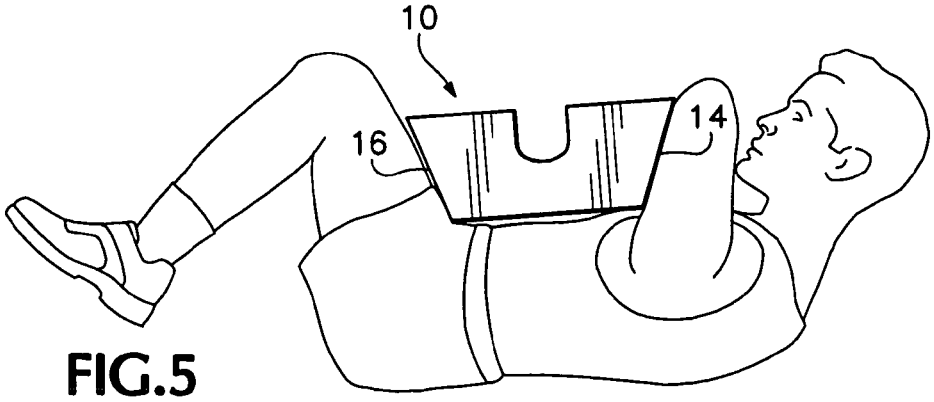
FIG. 5 is a side view of the exercise pad of FIG. 3 in use with the user's arms folded across the pad.

In its preferred form, the resistance and the surfaces are combined in a specially shaped compressible and resilient pad 10 (refer to FIG. 2). The pad 10 has a first substantially planar surface that is intended to rest on the anterior torso of the user. Second and third substantially planar surfaces 14, 16 extend away from the first surface 12 at oppositely inclined angles of 20° from the vertical (as shown by the dashed line and arrow in FIG. 2). When the device is resting on the torso of the user, the user will engage the second surface 14 with the arms. This could be in the position with the hands extended behind the head, in which case the user will engage the second surface 14 with the underside of the upper arms (see FIG. 3). Another way of performing the exercise is for the user to press against the second surface 14 with the forearms crossed across the pad (see FIG. 4). This applies for both a crunch and a crossover crunch.

The third, or back, surface of the device 16 is engaged by the upper thighs. The top surface 18 is substantially flat but may include a cutout portion or void 20. The void 20 need not have any particular shape but a U-shaped or V-shaped trough is among the easiest type to manufacture. With the void, significant resistance from the device is not encountered until the void is closed by compression. Inserts, such as insert 22 that correspond to the shape of the void, may be inserted into the void to adjust the resistance of the device.

The device can be made from a resilient material such as a high-quality polyurethane foam. This provides substantially uniform resistance and compressibility. This resistance can be altered to suit user requirements but nominally a K18 (1.8–18) foam may be used. Depending upon the degree of compressibility required, foams from K22 or K24 to K12 may also be used. Furthermore, the inserts may have different compressibility factors. For example, the exercise device could be made from K18 polyurethane foam but could also include an entire set of inserts shaped like insert 22 that range in compressibility and elasticity between K24 and K12. Thus as the user progresses in an exercise regimen, denser and less compressible inserts may be used to increase the overall resistance of the exercise device.

In actual use, the user places the exercise device on his anterior torso, top side 18 up. The user then engages the second and third surfaces 14, 16 with the arms and thighs respectively, and contracts the abdominal muscles thus forcing the upper thighs and the upper arms toward each other. The exercise device 10 will compress, resisting this motion and impeding momentum. At the same time, the exercise device provides proper support for the body. Thus, it is the resistance of the device itself and not the weight of the arms or legs that determines the effectiveness of the exercise and also insures that the proper muscle groups are used in performing the exercise. The presence of uniform resistance to the abdominal muscles in the path of the exercise movement with the lower back remaining substantially flat provides focused exercise to the abdominal muscles without transfer of excessive stress to the back.

For use in a crossover, the user maintains contact of the upper arms and legs as indicated, but applies simultaneous pressure to the device from opposing arms and legs.

Because at the initiation of the exercise the arms and thighs engage a single source of uniform resistance, such as a compressible foam pad, they are maintained in proper position and there is no unintended twisting or abrupt motions. Thus, proper posture during the performance of the exercise is maintained and motions extraneous to the exercise itself are minimized. This helps to isolate the abdominal muscles and relieve strain on the lower back muscles.

The presence of resistance in the space between the arms and legs also affords the ability to hold compression against the device at any point during the exercise. The posture is held against the opposing force being exerted by the device. A device comprised of polyurethane foam will provide the user with proportionally increasing resistance as the material is compressed.

The void or cut out portion need not be exactly U-shaped to provide for modification of resistance and a place to receive inserts of foam material. A differently shaped void or even transverse cylindrical channels may be used.

The angle of the second and third surfaces has been shown in FIG. 2 as a 110° obtuse angle relative to the first surface. In practice, other obtuse or acute angles may yield acceptable results. Obtuse angles in a range from 100° to 120° may be used and the angles for the second and third surfaces need not be equal. For example, depending upon the arm position and the body type of the use, a shallower angle on the second (arm engaging) surface may be preferred. The length of surfaces 10, 12 and 14 may be modified to accommodate body size.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A method of performing a crunch or crossover exercise for strengthening the abdominal muscles of a user comprising the steps of:

(a) providing a compressible and resilient pad having a substantially flat first surface adapted to lie on the abdomen of a user while in a supine position, the pad having a second surface formed at a first obtuse angle to the first surface and a third surface formed at a second obtuse angle to the first surface;

(b) engaging the second surface with the arms and engaging the third surface with the upper thighs;

(c) contracting the abdominal muscles such that the arms and upper thighs push against said second and third surfaces thereby compressing the pad.

2. The method of claim 1, step (a), further including the substeps of:

(1) providing a void in an upper surface of the pad;

(2) providing inserts for said void of materials having different densities and compressibility factors;

(3) placing a selected one of said inserts into said void prior to performing steps (b) and (c).

3. The method of claim 2 wherein the void comprises a substantially U-shaped void.

4. An exercise device for providing resistance to a user in the performance of an abdominal crunch or crossover exercise while the user is lying supine, comprising a resilient and compressible pad of material having a first substantially planar surface for placement upon the abdomen of the user, a second surface extending at an obtuse angle to the first surface and sized and shaped to engage the upper thighs of the user while performing said crunch exercise, and a third surface extending at an obtuse angle to the first surface and sized and shaped to contact the arms of the user while performing a crunch or crossover exercise wherein at least portions of said second and third surfaces are forced toward each other when said exercise is performed by a user.

5. The exercise device of claim 4 further including a top surface having a void for receiving inserts of material of different densities and compressibilities to thereby define the degree of resistance encountered by the user when performing said crunch exercise.

6. The exercise device of claim 5 wherein said void portion is substantially U-shaped in cross section.

7. The exercise device of claim 4 wherein said obtuse angle is in the range of 100° to 120° relative to said first surface.

* * * * *

UNITED STATES PATENT AND TRADEMARK OFFICE

CERTIFICATE OF CORRECTION

PATENT NO. : 7,150,703 B2
APPLICATION NO. : 10/625019
DATED : December 19, 2006
INVENTOR(S) : Paul R. Gary It is certified that error appears in the above-identified patent and that said Letters Patent is hereby corrected as shown below:

Column 2, line 55: In the phrase "... each other but they will ... ," delete "but" and replace it with a comma -- , --.
The corrected phrase should read "... each other, they will ... ".

Column 4, line 7: The word "use" should read -- user --.

Signed and Sealed this

Sixth Day of March, 2007

JON W. DUDAS
*Director of the United States Patent and Trademark Office*